United States Patent [19]

Alexander

[11] 4,102,527

[45] Jul. 25, 1978

[54] GRIPPING PRY TOOLS FOR DISLODGING CONCRETE FORMS AND THE LIKE

[76] Inventor: Dewey D. Alexander, 18898 Lumpkin, Detroit, Mich. 48234

[21] Appl. No.: 804,907

[22] Filed: Jun. 9, 1977

[51] Int. Cl.[2] ..... B66F 15/00

[52] U.S. Cl. ..... 254/131; 29/267

[58] Field of Search ..... 254/131, 120, 30; 294/17, 101, 104; 29/267

[56] References Cited

U.S. PATENT DOCUMENTS

| | | | |
|---|---|---|---|
| 1,907,048 | 5/1933 | Detweiler | 254/131 |
| 3,826,471 | 7/1974 | Orton et al. | 254/131 |
| 3,991,976 | 11/1976 | Skinner | 254/131 |
| 4,026,522 | 5/1977 | Dranselka | 254/132 |

FOREIGN PATENT DOCUMENTS

| | | | |
|---|---|---|---|
| 113,688 | 8/1941 | United Kingdom | 254/30 |

*Primary Examiner*—Robert C. Watson
*Attorney, Agent, or Firm*—Krass & Young

[57] ABSTRACT

A handtool is disclosed particularly adapted to engage concrete forms for prying the same loose from the concrete after setting. The tool includes a gripping mechanism carried on a tool frame, the gripper mechanism enabling the lip portion of the concrete form to be gripped or clamped during the prying operations to maintain the engagement of the tool with the concrete form. The tool frame includes a support member for the gripper mechanism extending transversely to the tool handle which provides leverage for prying the form while it is engaged with the gripper mechanism. The gripper mechanism consists of a self-engaging cam clamp element pivotally supported and spring-biased to the engaging position with a release handle provided for releasing the grip from the form.

6 Claims, 5 Drawing Figures

GRIPPING PRY TOOLS FOR DISLODGING CONCRETE FORMS AND THE LIKE

BACKGROUND OF THE INVENTION

1. Field of the Invention.

This invention concerns pry tools and more particularly pry tools especially adapted for dislodging concrete forms from set concrete.

2. Description of the Prior Art.

In the construction of concrete buildings, the floors or decks are commonly constructed with integral webs or beams which provide the necessary strength to support the poured concrete floors or decking. In carrying out this construction, it is a common practice to utilize sheet steel forms or pans which generally are U-shaped in configuration, with a terminal lip at each free end of the form. A plurality of parallel rows of form pans in end to end alignment are provided to make up a concrete form in which the spaces between the sides of the rows of form pans provides the mold cavity for forming the webbing or beams. Plywood forms are shored in position from beneath the form pans and the floor poured over the top and between the form pans. After pouring of the concrete, the form pans must be dislodged from the set concrete, which task has not heretofore been able to be easily carried out without encountering considerable dificulties.

Firstly, the workers are obliged to work overhead which requires a very taxing physical effort.

Secondly, the dislodging process has been relatively slow and time-consuming since there has heretofore been no highly effective manner of engaging the form pans with a pry tool. Generally, simple pry bars or crowbars have been used to pry loose the form pans. However, the lip edges of the form pans are not overly large and the unbraced configuration of the form pans prevents the pry bar from obtaining effective engagement with the lip since the form pan sides tend to deflect away and lose engagement with the pry bar. The edge itself is also relatively easy to bend and the engagement of the pry bar has a tendency to grossly deform the form pans and prevent the exerting of sufficient force to produce dislodging.

The resulting difficulties encountered by the construction workers renders this particular task rather labor intensive and time consuming and is further a dangerous and tiresome task. Also, the nature of the construction process relating to this particular stage of construction is such that it is very common for large numbers of workers to be waiting for removal of such form pans, this task thus representing a bottle-neck operation in the overall process.

It would be highly advantageous if this process could be carried out in a more expeditious manner since the related labor costs could be greatly reduced in those instances where large numbers of construction workers are forced to wait for the completion of this task. Also, it would be much to the advantage of the workers actually engaged in the activity since the effort involved is so considerable as described and further the direct labor costs could be reduced if the dislodging process could be expedited.

Accordingly, it is an object of the present invention to provide a pry tool which is particularly adapted to this task and which renders the process much more expeditious and less physically burdensome to the workers involved.

It is a further object of the present invention to provide such a tool which can be applied to other situations in which sheet-like members or panels must be pryed or pulled relative to a structure in which difficulties are involved in obtaining a good prying engagement of tools with the panel.

SUMMARY OF THE INVENTION

These and other objects which will become apparent upon a reading of the following Specification and Claims are accomplished by a pry tool in which is incorporated a gripping mechanism which is adapted to automatically engage and grip the form pan or other panel structure and which is mounted on a tool frame so as to enable the worker to exert considerable leverage on the gripped form pan or panel structure to enable considerable prying forces to be easily applied by the tool user. The gripper mechanism as noted includes a self-engagement feature which is readily releasable in order to release the form pan or panel after a prying or dislodgement of the form pan. The tool itself is rugged in construction involving a relatively sturdy frame structure with an extended handle section adapted to resist the large bending forces which may be exerted by virtue of the leverage afforded by the frame and attached tool handle. The clamping mechanism is of similar construction and reliable in operation containing a minimum number of relatively rugged elements.

DETAILED DESCRIPTION

In the following detailed description, certain specific terminology will be utilized for the sake of clarity and a specific embodiment described in accordance with the requirements of 35 USC 112, but it is to be understood that the same is not intended to be limiting and should not be so construed inasmuch as the tool according to the present invention is capable of taking many forms and variations within the scope of the appended Claims.

Figure 1:
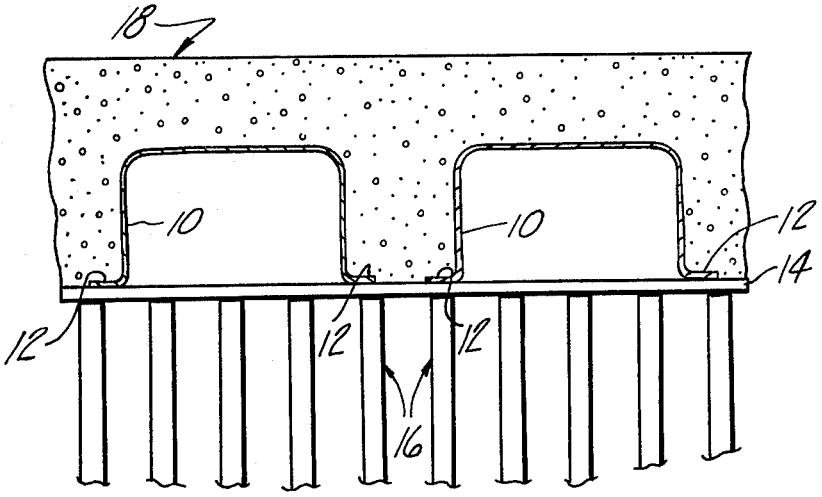
FIG. 1 shows a form pan in position and a concrete structure of the type in which the tool according to the present invention is particularly adapted to be used.

Referring to the Drawings, and particularly to FIG. 1, the situation to which the tool according to the present invention has particular application is in the pouring of concrete decks such as is commonly practiced in modern construction techniques. According to this practice, sheet steel form pans 10 are layed out in spaced apart parallel rows each comprised of an end to end series of form pans as shown in FIG. 1. Each form pan 10 comprises generally U-shaped sheet steel form having a terminal lip edge 12 provided. The lower surface of the form pan series is layed out on a plywood form 14 which is supported by a shoring 16 from beneath. The spacing between each row or series of form pans 10 provides a mold cavity for poured concrete webbing or beam structure which provides sufficient structural support for the deck, the upper surface 18 of which forms a building floor in a manner well known to those skilled in the art.

It is the removal of these form pans 10 after the concrete has set which is the problem with which the present invention is concerned. The form pans 10 are formed of rather light-weight sheet steel and the dimension of the lip 12 is such that an adequate prying force is difficult to exert on the form pan and the overhead location of the form pan 10 renders the task very wearisome.

Generally it is the practice to dislodge these form pans 10 by the use of pry bars or other similar prying instruments.

Figure 2:
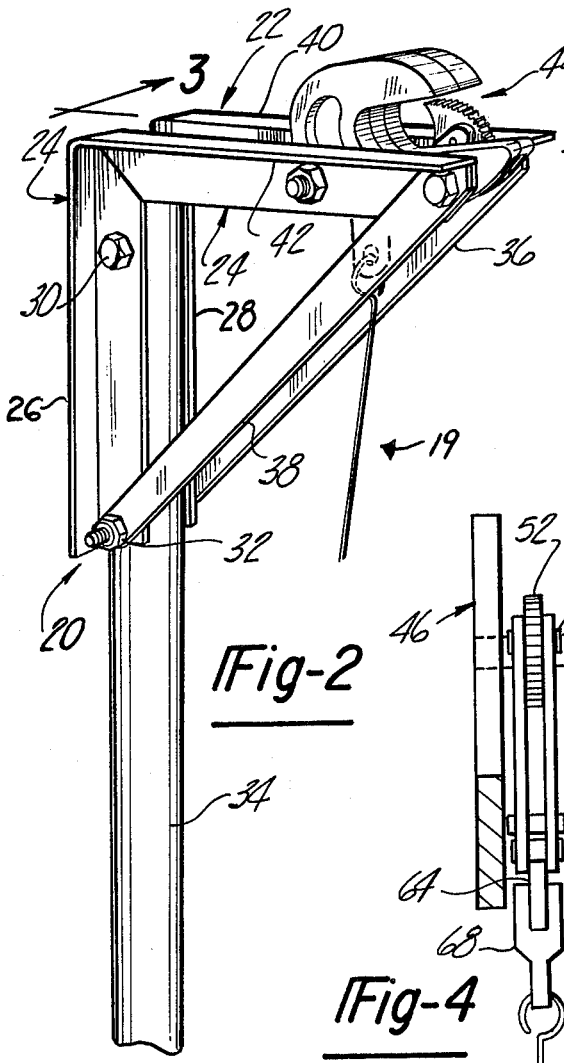
FIG. 2 is a perspective view of the pry tool according to the present invention.
Figure 3:
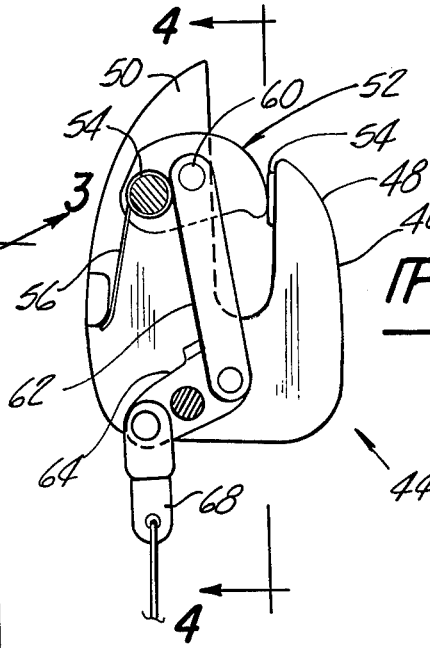
FIG. 3 is an enlarged detailed view of the gripper mechanism incorporated in the tool according to the present invention.
Figure 4:
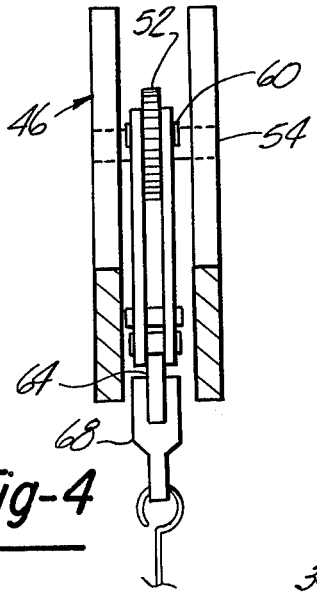
FIG. 4 is an end view of the gripper mechanism shown in FIG. 3.

According to the concept of the present invention a gripping pry tool 19 is provided shown in FIGS. 2 through 4 which is adapted to securely engage the lips 12 by virtue of a self-clamping or gripping of the lips 12 of the form pans 10 which allows a secure engagement with the lip 12 of the form pan during the dislodgement process.

The gripper tool 19 includes a tool frame 20 comprised of a pair of angle iron members 22 and 24 having first portions 26 and 28 which extend along a tool handle 34 and are bolted thereto at 30 and 32. A pair of cross braces 36 and 38 are bolted to the portions of angle iron legs 26 and 28 at one end thereof and at the other end serve to brace angle iron members 40 and 42 which extend outwardly from the tool in a transverse direction normal to the tool handle 34 axis a lesser distance than the tool handle 34 length to afford a mechanical advantage or leverage exerted by the tool handle 34. At the outer ends of the angle iron members 40 and 42, a gripper mechanism 44 is mounted between these members as shown.

The gripper mechanism 44 is of a type which is known in the prior art per se and may be of a type which is commonly used for gripping panel members in such applications as sheet metal clamping mechanisms for hoists. The gripper mechanism 44 is shown in detail in FIGS. 3 and 4.

According to the concept of the present invention, such a gripping mechanism 44 is mounted within a tool frame 20 so as to receive the lip or panel to be engaged along a direction generally parallel with the angle iron portions 42 and 40, i.e., transverse to the axis of the tool handle 34.

The clamping mechanism 44 includes a gripper mechanism 46 including means for receiving and gripping a sheet member lying in a plane generally extending transversely to the tool handle 34. The gripper mechanism is thus provided with a pair of jaws 48 and 50 having an opening extending transversely to the tool handle so as to be adapted to receive the lip 12 therebetween and includes a clamping cam 52 which is adapted to automatically engage the lip 12 upon being disposed between the clamping cam 52 and a clamping button 54 carried on and mounted to the interior surface of jaws 48. The clamping cam 52 is pivotally mounted at 54 to the other frame jaw 50. A leaf spring 56 anchored at 58 and engaged with a pin 60 which mounts a parallel link 62 biases the clamping cam 52 counterclockwise as viewed in FIG. 3 so as to tend to rotate the clamping cam 58 about the pivotal mounting point 54 and reduce the gap between the clamping button 54 and the outer surface of clamping cam 52. The clamping cam 52 has an outer surface of a configuration such that upon disposition of the lip 12 into the space between the clamping button 54 and cam 52 and upon exertion of the frictional engagement forces induced by the spring bias means afforded by the leaf spring 56, a jamming or self-engagement action is produced upon attempted withdrawal of the lip 12. Thus, upon disposition of the lip 12 into this clearance space, there is an automatic gripping or clamping action exerted thereon.

In order to release the lip 12 after the tool has been utilized to dislodge the panel form, a release mechanism including the parallel links 62 is provided in which parallel links 62 are pinned to a release lever 64 pivotally mounted with the tool frame 46 at 66 with a release handle 68 provided on the other end of the release lever 64. Pushing the handle upwardly rotates the clamping cam clockwise as seen in FIG. 3 against the bias of the leaf spring 56 and allows the lip 12 to be withdrawn.

Figure 5:
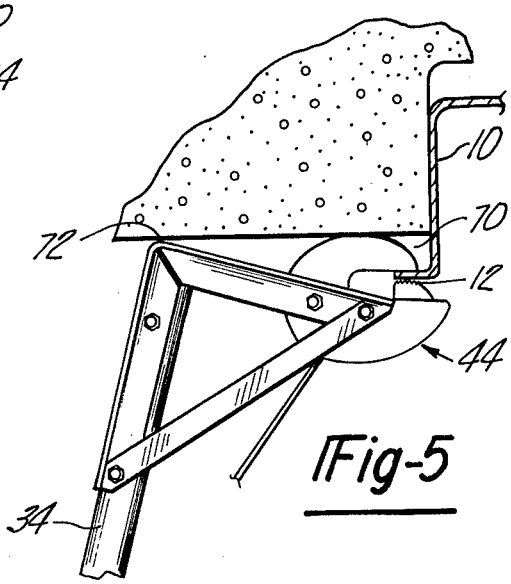
FIG. 5 is a side view of the gripper pry tool according to the present invention shown in working engagement with the form pan shown in FIG. 1.

In use, the form pan 10 would be initially dislodged sufficiently from the concrete structure by means of a conventional crowbar or pry tool to produce a clearance space 70 between the concrete structure and the lip 12 sufficient to insert the lip 12 into the gripper mechanism 44 as shown in FIG. 5.

The leverage afforded by the positioning of the corner 72 of the angle iron members 22 and 24 in engagement with the concrete structure and the relative length of the handle 34 provides a mechanical advantage to the worker allowing relatively easy application of considerable dislodging force while the gripper mechanism 44 insures that the form pan 10 is not deflected away from the tool and producing loss of engagement of the tool therewith as the position of the tool shifts during rotation about the corner 72. Also, the lip 12 is securely clamped towards this same end.

It thus can be seen that the tool affords a relatively highly effective means of applying a very considerable dislodging pry force rendering the task much more expeditiously carried out than has been possible by the conventional methods described above. The tool itself is simple in construction and sturdy in design so as to be capable of being manufactured at very low cost and capable of absorbing the abuse which commonly is encountered by equipment and tools used at construction sites.

Thus, the process of removing such form pans is greatly speeded up, saving considerable labor costs, both direct and indirect, greatly reducing the physical exertions required by the individuals assigned this task and eliminating the tendency for this particular procedure of being a bottleneck operation.

While the tool disclosed has particular application to this situation, it should, of course, be understood that the tool can also be applied in any situation where plate or panel members must be forced loose as in wrecking operations or other concrete form dislodgement applications.

The embodiments of the invention in which an exclusive property or privilege is claimed are defined as follows:

1. A gripper pry tool comprising:

a tool frame;

a tool handle affixed to said tool frame and extending therefrom;

said tool frame including portions thereof extending transversely to said tool handle a lesser distance than the length of said tool handle;

a gripper mechanism mounted to said tool frame portions, said gripper mechanism including means to receive and grip a sheet member lying in a plane generally extending transversely to said tool handle, said means including gripper jaws having an opening therebetween extending transversely to said tool handle to thereby be adapted to receive a portion of a sheet member to be pried extending transversely to said tool handle, said means further including clamping means engaging said portion of said sheet member upon insertion of said portion into said opening and resisting withdrawal thereof to securely grip the inserted portion upon prying of said sheet member by movement of said tool handle;

whereby said sheet member may be pried by the leverage afforded by said tool handle and said gripper mechanism jaws while being securely engaged by said gripper mechanism clamping means to prevent transverse movement of said sheet member away from said tool.

2. The gripper pry tool according to claim 1 further including release means manually operable to release said clamping means.

3. The gripper pry tool according to claim 2 wherein said gripper mechanism includes a clamping cam pivotally mounted within said gripper mechanism, said gripper mechanism further including a clamping surface affixed to said gripper mechanism jaws opening and configured to automatically be drawn into clamping engagement with said portion of said sheet member when said portion is inserted between said clamping cam and said clamping surface.

4. The gripper mechanism according to claim 3 further including spring bias means biasing said clamping cam to move about said pivotal mount into engagement with said clamping surface.

5. The gripper tool according to claim 1 wherein said tool frame comprises a pair of frame members, each having a first portion extending along said tool handle and affixed thereto and each frame member having a second portion extending normally to said first portion and wherein said gripper mechanism is mounted between said second portion at the outer ends thereof.

6. The gripper pry tool according to claim 5 further including a brace member extending between said first and second portions of each of said pair of frame members.

* * * * *